US009612066B2

(12) United States Patent
Kerbrat et al.

(10) Patent No.: US 9,612,066 B2
(45) Date of Patent: Apr. 4, 2017

(54) BOLT GUIDANCE SYSTEM

(71) Applicant: Kriss Systems SA, Nyon (CH)

(72) Inventors: Renaud Kerbrat, Gland (CH); Antoine Robert, Morges (CH); Jan Henrik Jebsen, Crans-pres-Celigny (CH)

(73) Assignee: KRISS SYSTEMS SA, Nyon (CH)

( * ) Notice: Subject to any disclaimer, the term of this patent is extended or adjusted under 35 U.S.C. 154(b) by 0 days.

(21) Appl. No.: 14/760,542

(22) PCT Filed: Jan. 14, 2014

(86) PCT No.: PCT/IB2014/058255
§ 371 (c)(1),
(2) Date: Jul. 13, 2015

(87) PCT Pub. No.: WO2014/108881
PCT Pub. Date: Jul. 17, 2014

(65) Prior Publication Data

US 2015/0354910 A1 Dec. 10, 2015

(30) Foreign Application Priority Data

Jan. 14, 2013 (CH) ..... 0154/13

(51) Int. Cl.
*F41A 3/66* (2006.01)
*F41A 3/64* (2006.01)
(Continued)

(52) U.S. Cl.
CPC *F41A 3/64* (2013.01); *F41A 3/50* (2013.01); *F41A 3/66* (2013.01); *F41A 3/78* (2013.01)

(58) Field of Classification Search
CPC ..... F41A 3/50; F41A 3/46; F41A 3/44; F41A 3/64; F41A 3/66
(Continued)

(56) References Cited

U.S. PATENT DOCUMENTS 5,517,897 A * 5/1996 Perrine ..... F41A 15/16 42/25
7,201,094 B2 4/2007 Jebsen
(Continued)

FOREIGN PATENT DOCUMENTS

WO WO 2008/130460 * 10/2008

OTHER PUBLICATIONS

International Search Report and Written Opinion of the International Searching Authority, PCT/IB2014/058255, Apr. 4, 2014.

*Primary Examiner* — Stephen M Johnson
(74) *Attorney, Agent, or Firm* — Perkins IP Law Group LLC; Jefferson Perkins

(57) ABSTRACT

Firearm comprising a projectile barrel (15), a firing chamber body (16) fixed to the barrel, a breech mechanism (12) for loading a projectile in the firing chamber and ejecting the spent cartridge from the firearm after detonation, a mobile bolt (1), and a receiver structure (13) that supports and guides the mobile bolt. The mobile bolt comprises lateral bearings projecting laterally from opposite sides of the bolt, a first pair of lateral bearings (4, 4') positioned towards a front portion of the bolt and a second pair of the lateral bearings (10, 10') positioned towards a rear portion of the bolt. The receiver structure comprises sidewalls (2, 2') each have bolt bearing raceway grooves (3, 3') slidably receiving and guiding the lateral bearings of the bolt, wherein a profile of a first portion (3*a*) of the bolt bearing raceway groove defines a non-constant height (H(y)) between upper and lower guide edges (18, 19) that varies as a function of the distance (y) from the firing chamber body (16), said profile comprising a velocity control portion with a slope (P) configured to impart a braking effect on the bolt during its sliding movement to slow down the rate of fire.

6 Claims, 4 Drawing Sheets

(51) Int. Cl.
*F41A 3/50* (2006.01)
*F41A 3/78* (2006.01)

(58) Field of Classification Search
USPC ..... 89/189, 175, 194
See application file for complete search history.

(56) References Cited

U.S. PATENT DOCUMENTS

| | | | |
|---|---|---|---|
| 7,997,183 | B2 | 8/2011 | Jebsen |
| 2006/0254414 | A1 | 11/2006 | Kuczynko |
| 2012/0240760 | A1 | 9/2012 | Pizano |
| 2012/0304518 | A1 | 12/2012 | Kerbrat |

* cited by examiner

BOLT GUIDANCE SYSTEM

FIELD OF THE INVENTION

The present invention relates to automatic firearms, in particular to components of a firearm relating to the bolt mechanism including the bolt of a gun and the bolt guiding means.

BACKGROUND

U.S. Pat. Nos. 7,997,183 and 7,201,094 describe a firearm with a bolt mechanism that has a movement component perpendicular to the projectile barrel axis. Firearms manufactured according to the teachings of the aforementioned patents are commercialized under the trademarks KRISS Vector™ and Super V System™. The forementioned firearm has the particularity of redirecting the moving bolt from the firing axis to a downward direction thus reducing muzzle climb and recoil force. The redirection of bolt movement is obtained by means of V-shaped grooves provided in the internal surface of the opposed sidewalls of the bolt receiver assembly. The V-shaped grooves have a first portion parallel to the firing axis, and a second portion transverse to the firing axis. The unique configuration of this bolt movement mechanism has an influence on the rate of fire, which many users have felt to be too rapid. A rapid rate of fire may also decrease the reliability and constancy of cartridge ejection, especially in fully automatic mode of fire, but also in semi-automatic mode of fire.

The forementioned problems are not limited to KRISS type firearms and may also be found in firearms with linear bolt movement mechanisms.

SUMMARY OF THE INVENTION

An object of the invention is to provide a firearm with a bolt mechanism that has an optimally controlled and reliable firing rate.

It is advantageous to provide a firearm that reliably ejects the spent cartridges, especially at high automatic firing rates.

A particular object of the invention is to provide a firearm capable of operating with a bolt mechanism having a movement component transverse to the projectile barrel axis, for instance as taught in U.S. Pat. No. 7,997,183 and U.S. Pat. No. 7,201,094, that has an optimally controlled automatic firing rate and reliable cartridge ejection.

It would be advantageous to provide a bolt assembly that allows easy assembly and use and is economical to manufacture.

It would be advantageous to provide a bolt assembly for a firearm that ensures reliable and low maintenance operation of the firearm.

Objects of the invention have been achieved by providing a firearm with a bolt mechanism according to claim 1. Dependent claims define some of the advantageous features of embodiments of the invention.

Disclosed herein is a firearm comprising a projectile barrel, a firing chamber body fixed to the barrel, a breech mechanism for loading a projectile in the firing chamber and ejecting the spent cartridge from the firearm after detonation, a mobile bolt, and a receiver structure that supports and guides the mobile bolt. The mobile bolt comprises lateral bearings projecting laterally from opposite sides of the bolt, a first pair of lateral bearings positioned towards a front portion of the bolt and a second pair of the lateral bearings positioned towards a rear portion of the bolt. The receiver structure comprises sidewalls each have bolt bearing raceway grooves slidably receiving and guiding the lateral bearings of the bolt, wherein a profile of a first portion of the bolt bearing raceway groove defines a non-constant height between upper and lower guide edges that varies as a function of the distance from the firing chamber body, said profile comprising a velocity control portion with a slope configured to impart a braking effect on the bolt during its sliding movement to slow down the rate of fire.

In an advantageous embodiment, the velocity control portion may be arranged along an upper guide edge of the bolt bearing raceway groove.

In an advantageous embodiment, the velocity control portion may have a rearwardly facing angled slope configured to brake the forward bolt movement on a return portion of a firing cycle corresponding to loading of a new round into the firing chamber.

In an advantageous embodiment, the front lateral bearings comprise an oblong shape with a major axis extending in a direction parallel to a first portion of the bolt bearing raceway groove extending from the firing chamber, and a minor axis orthogonal thereto, a width of the front lateral bearing in said direction parallel to said first portion of the bolt bearing raceway groove being greater than a height of the front lateral bearing.

In an advantageous embodiment, the rear lateral bearings may comprise a cylindrical shape, at least in part, having a diameter that is greater than the height of the front lateral bearings.

In an advantageous embodiment, the height of the bolt bearing raceway groove at a position proximate the firing chamber body, corresponds to the front bearing height, and towards an end of the bolt bearing raceway groove at a position remote from firing chamber, the height corresponds to the bolt rear bearing height or diameter.

In an advantageous embodiment, the slope of the velocity control portion may be provided with an angle selected to obtain a controlled specified rate of fire, whereby a more acute the angle of this slope increases the braking effect.

In an advantageous embodiment, the bolt bearing raceway grooves may comprise a first portion parallel to a barrel axis, and a second portion transverse to said barrel axis, the first and second portions connected together to form a "V" shape.

In an advantageous embodiment, the velocity control portion may be provided in the first portion of the bolt bearing raceway groove, configured to guide and cooperate with the front lateral bearings of the bolt.

The invention is particularly useful in firearms capable of operating with a bolt mechanism having a movement component transverse to the projectile barrel axis, for instance as taught in U.S. Pat. No. 7,997,183 and U.S. Pat. No. 7,201,094. Firearms of the forementioned type have grooves formed in the internal surfaces of two opposed sidewalls of the bolt mechanism receiver. These grooves constitute raceways that slidably guide bearings projecting laterally from the movable bolt. The bolt has a first pair of laterally protruding bearings at a front end of the bolt and a second pair of laterally protruding bearings at a rear end of the bolt. A first portion of the raceway grooves allows the sliding of the bolt in a direction of the firing axis; the other transverse portion of the groove guides the downward movement of the bolt mechanism as it slides and tilts. The first portion of the raceway grooves is aligned with the barrel axis such that the bolt is initially in line with the centre of the cartridge pressure chamber at the moment of detonation. It may be further noted that the forementioned firearm operates on the principle of delayed blowback. The raceway grooves are formed by machining, or some other method, in the sidewalls of the receiver in order to accommodate the four bearings of the bolt. In the known firearm, the diameter of the bolt lateral bearings is equal to the depth of the aforementioned groove. This simplification is an advantage in terms of ease of manufacture, but it does not generate a braking effect capable of significantly reducing the rate of fire without some other complicated and cumbersome means or technique. This configuration is mechanically advantageous, considering the stresses borne by the mechanism components, however, results in a very high rate of fire, in view of the simple guide means. This configuration also results in high sidewalls in the receiver which impede the near-horizontal trajectory of ejection of the casing and thus requires positioning the bolt's ejection claw at an acute angle relative to the vertical plane. This has the effect of ejecting the casing upwards that can lead to falling of the ejected casing into the mechanism which may cause a misfire. The invention described herein overcomes these problems.

Further objects and advantageous features of the invention will be apparent from the claims and/or the detailed description of embodiments of the invention.

DESCRIPTION OF THE ILLUSTRATIONS

An embodiment of the invention is described below in more detail with reference to the annexed drawings in which:

FIGS. 1*a* and 1*b* are perspective views of a firearm operating with a bolt mechanism having a movement component transverse to the projectile barrel axis according to an embodiment of the invention;

FIG. 2*a* is a perspective view of part of a bolt mechanism receiver of the firearm of FIGS. 1*a*, 1*b* according to an embodiment of the invention;

FIG. 2*b* is a perspective view of the receiver of FIG. 2*a* with a left side plate removed to show the bolt and counterweight counterweight;

FIGS. 3*a*, 3*b* and 3*c* show different views of the bolt unit of a bolt mechanism according to an embodiment of the invention;

DETAILED DESCRIPTION OF AN EMBODIMENT OF THE INVENTION

Figure 1A:
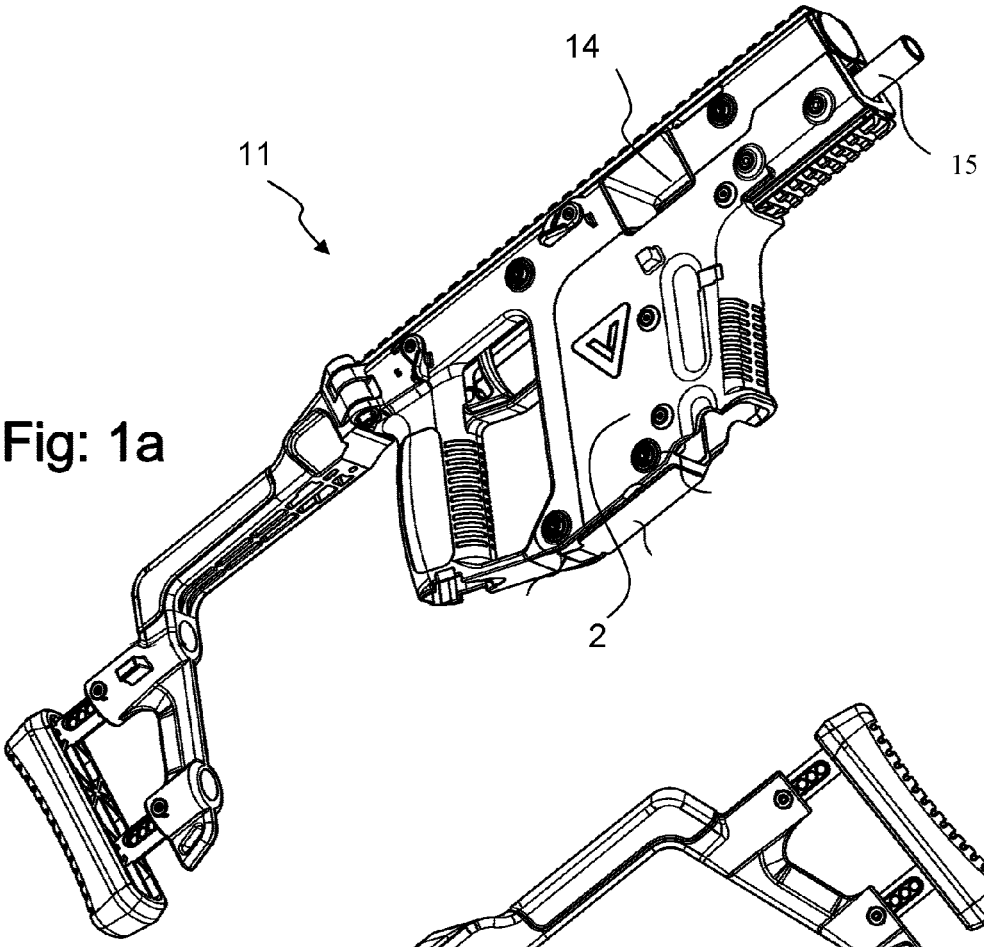
Figure 1B:
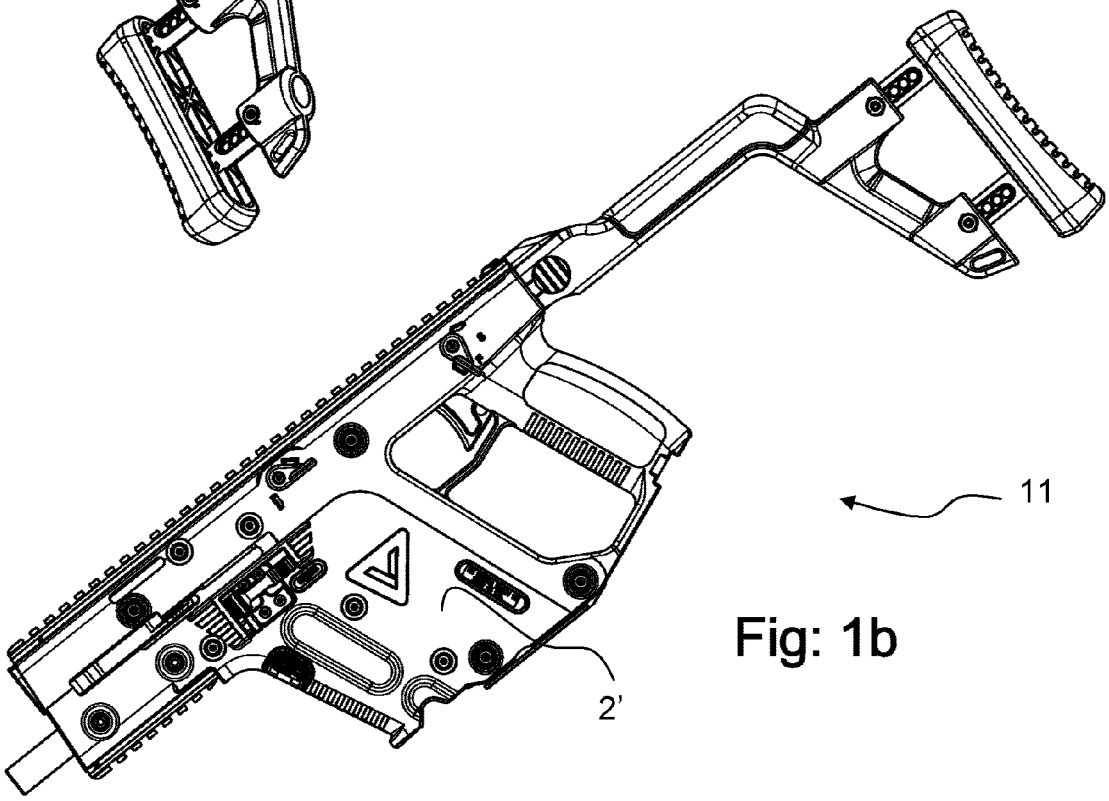
Figure 2A:
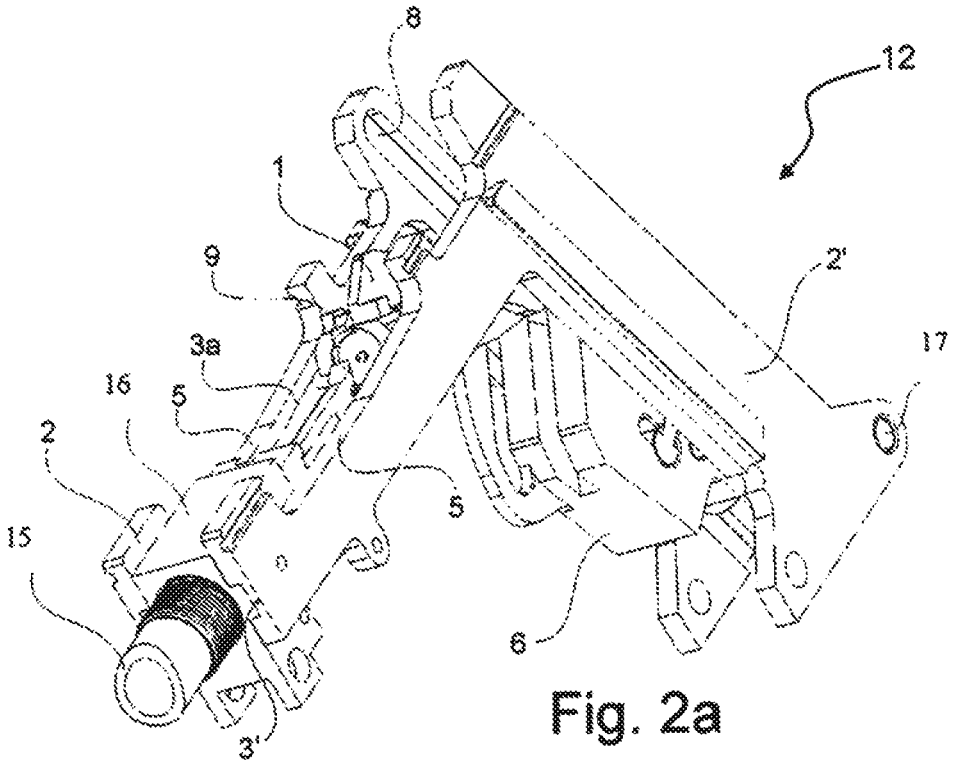
Figure 2B:
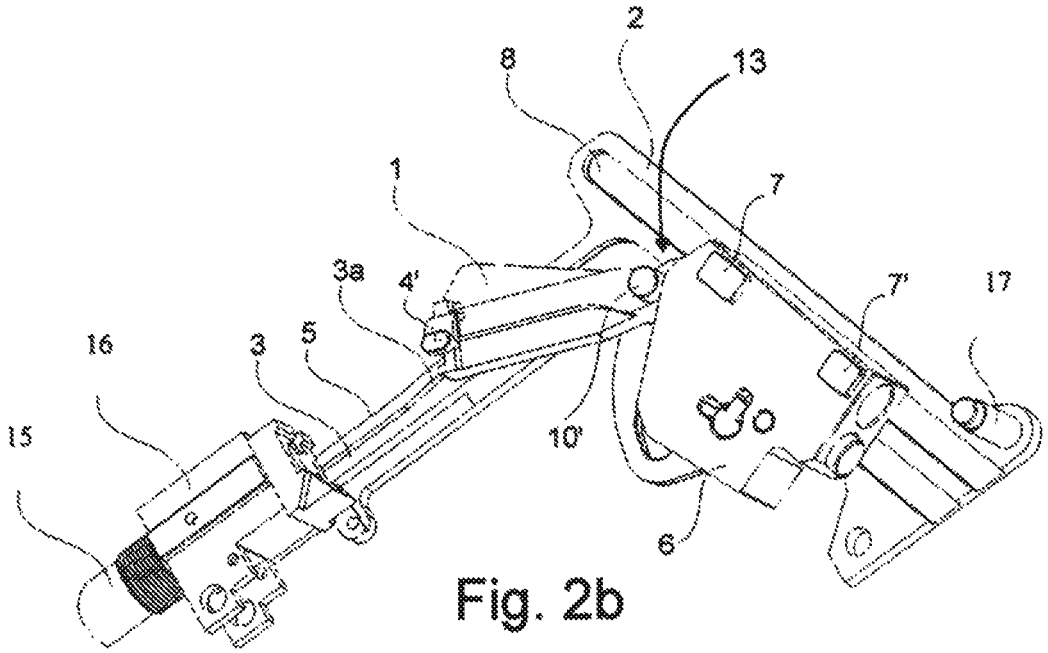
Figure 3A:
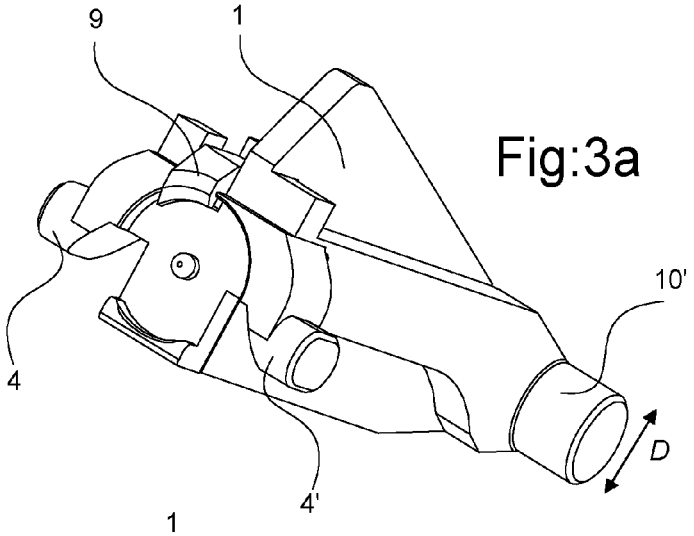
Figure 3B:
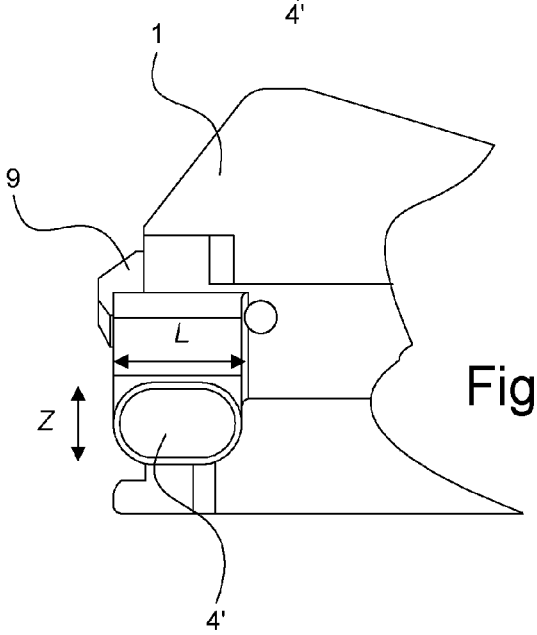
Figure 3C:
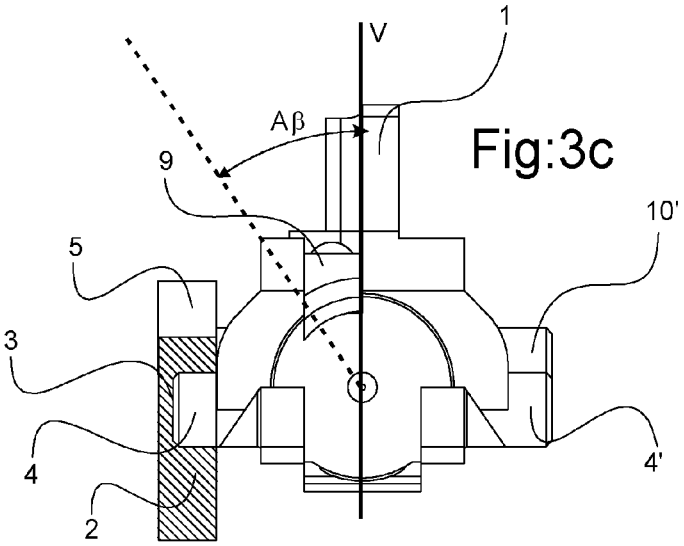
Figure 4:
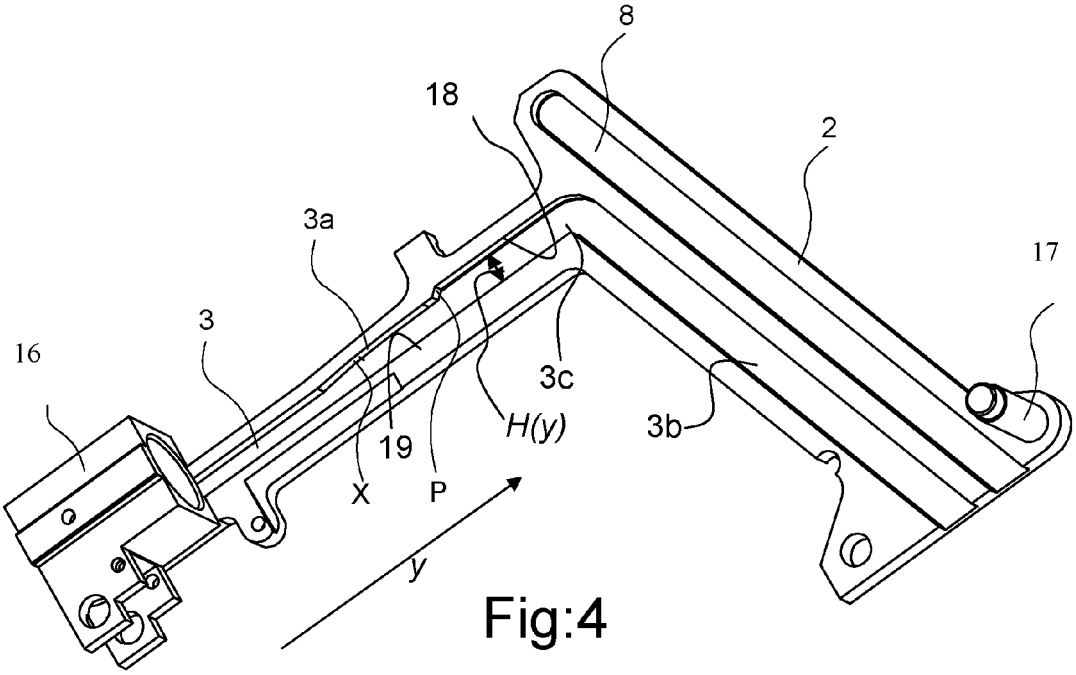
FIG. 4 is a perspective view of a right side plate of a bolt mechanism receiver according to an embodiment of the invention, showing the profile of a raceway groove on an inner side of the plate.
Figure 5:
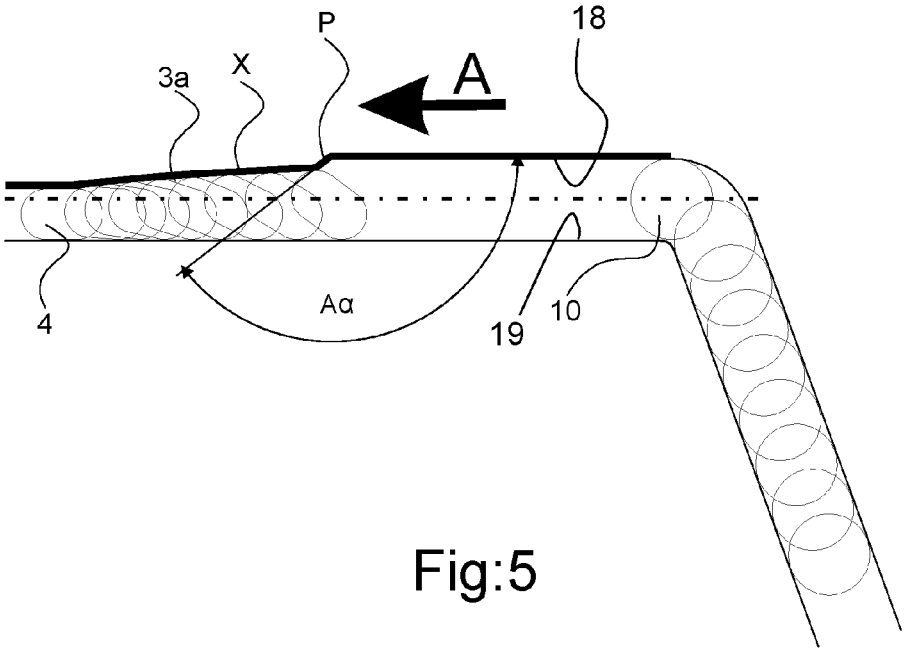
FIG. 5 is a schematic view illustrating the displacement and tilting of the bolt in the receiver raceway groove.
Figure 6:
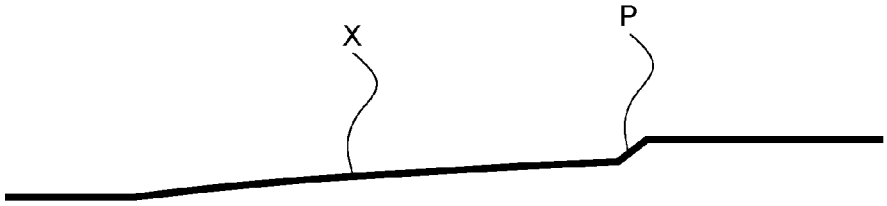
FIG. 6 shows in detail a profile of a section of the raceway groove of the embodiment of FIG. 4.

Referring to the figures, a firearm 11 according to an embodiment of the invention comprises a projectile barrel 15, a firing chamber body 16 fixed to the barrel 15, and a breech mechanism 12 for loading a projectile in the firing chamber and ejecting the spent cartridge from the firearm after detonation. The firearm of the present invention is of the general type known as a delayed blowback firearm.

The firearm according to an advantageous embodiment of the invention may have a bolt movement component transverse to a longitudinal axis Y of the projectile barrel based on the general principle of functioning of the firearms described in U.S. Pat. No. 7,997,183 and U.S. Pat. No. 7,201,094.

The breech mechanism 12 comprises a mobile bolt 1, a mobile counterweight 6 coupled to the bolt, a spring mechanism (not shown) applying a return force on the counterweight and bolt, and a receiver structure 13 that supports and guides the mobile bolt and counterweight and provides an anchor and support for the return spring mechanism.

The mobile bolt 1 comprises lateral bearings 4, 4', 10,10' in the form of studs projecting laterally from opposite sides of the bolt, a first pair of lateral bearings 4, 4' positioned towards a front portion of the bolt and a second pair of the lateral bearings 10, 10' positioned towards a rear portion of the bolt.

The receiver structure comprises two sidewalls 2, 2' spaced apart and joined together by a plurality of spacers 17 (only one is shown for clarity) and possibly other components such as the firing chamber body 16. The sidewalls 2, 2' each have bolt bearing raceway grooves 3, 3' formed in their inner surfaces facing the bolt mechanism and slidably receiving and guiding the lateral bearings 4, 4', 10, 10' of the bolt. The bolt bearing raceway groove on one sidewall may be identical in symmetry to the bolt bearing raceway groove in the opposite sidewall. In a preferred embodiment, the bolt bearing raceway grooves comprise a first portion 3*a* parallel to said barrel axis, and a second portion 3*b* transverse to said barrel axis, the first and second portions connected together to form a "V" shape. In this embodiment the first pair of lateral bearings positioned towards the front portion of the bolt and the second pair of the lateral bearings positioned towards the rear portion of the bolt are spaced apart by a distance configured to allow the bolt to tilt around a bend formed by the intersection 3*c* of the first and second portions of the bolt bearing raceway grooves 3*a*, 3*b*.

The mobile counterweight 6, forms an inertial mass that counteracts the blowback force of the projectile during detonation, as is per se well known in conventional firearms. The mobile counterweight 6 comprises bearings 7, 7' that are received and guided in complementary slide bearings in the receiver structure. In the embodiment shown, the bearings 7, 7' are in the form of lateral studs that are received and guided in counterweight bearing raceway grooves 8 formed in the inner sides of the sidewalls 2, 2', the raceway grooves extending essentially parallel to the second portion 3*b* of the bolt bearing raceway groove. Within the scope of the invention it would however be possible to have the bearings of the counterweight slide in the bolt bearing raceway grooves, instead of having separate raceway grooves for the bolt and counterweight.

The front lateral bearings 4, 4' advantageously have an oblong shape with a major axis extending in a direction parallel to the first portion 3*a* of the bolt bearing raceway groove and a minor axis orthogonal thereto. Said otherwise, the axial length or width L of the front bearing in the groove direction is greater than its height Z. The rear lateral bearings 10, 10' may advantageously have a simple cylindrical shape with a diameter D that is greater than the height Z of the front lateral bearings 4, 4'. Although a cylindrical rear bearing offers the simplest and most reliable form for the intended guide function, within the scope of the invention, other bearing shapes, for instance elliptical, semi-circular and others, may be envisaged if they are configured in conjunction with the raceway groove 3 to allow the rear lateral bearings to slide smoothly in the raceway groove, especially, as concerns the exemplary illustrated embodiment, around the intersection bend portion 3*c*.

The profile of the first portion 3*a* of the raceway groove 3 defines a non-constant height H(y) between upper and lower guide edges 18, 19 that varies as a function of the distance y from the firing chamber body 16. Proximate the firing chamber body 16, the height H(y) corresponds to the front bearing height Z, taking into account a certain small amount of play required to allow a smooth sliding of the bearing in the groove. Towards the end of the first portion 3*a* proximate the intersection 3*c*, the height H(y) corresponds to the bolt rear bearing height or diameter D, taking into account a certain small amount of play required to allow a smooth sliding of the bearing in the groove. Between the intersection 3*c* and the firing chamber body 16, the profile of the of the bolt bearing raceway groove defines a non-constant height H(y) that follows a complex development allowing the oblong front bolt bearings to slide and tilt as the bolt moves backwards.

The profile further comprises a velocity control portion X with a velocity control slope P disposed along the upper guide edge 18 of the raceway groove that has a slope configured to impart a braking effect on the bolt during its sliding movement to slow down the rate of fire.

The angle Aα of the velocity control slope P is configured to reduce the weapon's rate of fire, whereby the more acute the angle Aα of this slope P, the more significant the braking effect. The braking effect thus generated can be controlled to determine the rate of fire by the choice of the angle of the slope provided in the groove 3. In a preferred embodiment, the velocity control portion is provided in the first portion 3*a* of the bolt bearing raceway groove 3, configured to guide and cooperate with the front lateral bearings 4, 4' of the bolt 1. Within the scope of the invention it is however also possible to have a velocity control portion that is positioned further away from the firing chamber, configured to cooperate with the rear lateral bearings of the bolt, either as an alternative solution, or as an additional brake such that there are provided front and rear velocity control portions. In the latter variant (not illustrated), the front and rear velocity control portions may be configured to engage the front and rear lateral bolt bearings simultaneously, or sequentially.

In another variant (not shown) a velocity control portion in the form of a guide edge with a slope configured to engage bearings 7, 7' of the counterweight can also be provided either as an alternative solution to the above embodiments, or as an additional brake.

In a preferred embodiment, the velocity control portion has an angled slope configured to brake the forward bolt movement on the return portion of the firing cycle corresponding to the loading of a new round into the firing chamber. In the embodiment illustrated, the braking effect of angled slope of the velocity control portion is affected by the slight further pivoting of the bolt as the front bearing engages the slope P and the frictional force therebetween.

Within the scope of the invention, it would however also be possible to provide a variant where the velocity control portion has an angled slope configured to brake the rearward movement of the bolt on the ejection portion of the firing cycle either as an alternative solution to the above embodiments, or as an additional brake.

The velocity control portion is preferably disposed along the upper guide edge 18 of the raceway groove, however in an alternative variant, the velocity control portion may be provided on the lower guide edge 19 of the bearing raceway groove.

The oblong shape of the front bearings 4, 4' of the bolt 1 are advantageous in that they provide a high mechanical resistance or strength in the axial direction Y, but a low height that allows the receiver sidewall to have a low height along the top edge section just behind the firing chamber body 16. This top edge section, which we name herein the ejection edge 5, is aligned with the ejection port 14 of the firearm. This reduced height provides more space to create a wider ejection port 14 in the firearm. This advantageously further allows the repositioning of the bolt's extractor claw with a more obtuse angle Aβ relative to the vertical plane V and in so doing, improves the reliability of ammunition casing ejection.

EXAMPLE OF OPERATION OF THE ILLUSTRATED EXEMPLARY EMBODIMENT

After detonation of a round of ammunition, the blowblack pressure on the ammunition casing propels the bolt 1 and counterweight 6 rearwardly, the inertial mass of the bolt and counterweight and the force of the spring system counteracting the blowback force. The counterweight is driven down the receiver against the spring compression bias, guided by the counterweight bearing raceway grooves 8. The rear lateral bearings 10, 10' of the bolt engage into the second portion 3*b* of the bolt bearing raceway groove. In the return phase, approximately halfway through the horizontal displacement of the front bearings 4, 4' in the bearing raceway portion groove 3*a*, the front bearings 4, 4' comes into contact with the slope P which has the effect of providing temporary resistance to the return movement of the bolt. The angle Aα of this slope P is chosen by the firearms designer within a range of possible functioning angles, to generate the desired reduction in firing rate.

After this slope P is crossed by the front bearings 4, 4', the specific profile X of the groove 3*a* follows a moderate slope, allows the oblong front bearings 4, 4' to facilitate accurate and smooth guidance of the bolt 1. In this way, the profile makes it possible to connect the different groove depths and facilitates the movement of the bolt's bearings. The final distance traveled by the bolt 1 is parallel to the barrel axis (arrow A), which is at least equal to the length of the ammunition casing being used.

REFERENCES USED IN THE FIGURES ARE

11 firearm
12 breech mechanism
1 bolt
4, 4' front bolt bearings
10, 10' rear bolt bearings
9 extractor claw
Aβ angle for repositioning the extractor claw
6 mobile counterweight
7, 7' counterweight bearings
13 bolt and counterweight receiver structure
2, 2' receiver sidewalls
3, 3' bolt bearing raceway grooves
3*a* first section
X velocity control portion
P velocity control slope
Aα angle of slope P
3*b* second section
5 ejection edge
8, 8' counterweight raceway grooves (for guiding moving counterweight)
17 spacer
16 firing chamber body
14 ejection port
15 barrel
V vertical plane
Z front bearing height
L front bearing axial length D rear bolt bearing diameter/height
H(y) height of bolt bearing raceway grooves
Y longitudinal axis (firing axis)

The invention claimed is:

1. A firearm comprising a projectile barrel, a firing chamber body fixed to the barrel and comprising a firing chamber, a breech mechanism for loading a projectile with a cartridge case in the firing chamber and ejecting the cartridge case from the firearm after detonation, the breech mechanism comprising a mobile bolt, and a receiver structure that supports and guides the mobile bolt, the mobile bolt comprising, a first pair of lateral bearings positioned towards a front portion of the bolt and a second pair of lateral bearings positioned towards a rear portion of the bolt, the receiver structure comprising sidewalls each having bolt bearing raceway grooves slidably receiving and guiding the lateral bearings of the bolt, wherein a profile of a portion of the bolt bearing raceway groove defines a non-constant height (H(y)) between upper and lower guide edges that varies along a distance (y) from the firing chamber body, said profile further comprising a velocity control portion with a slope (P) configured to impart a braking effect on the bolt sliding movement to slow down the rate of fire, wherein the velocity control portion has a rearwardly facing angled slope arranged along an upper guide edge of the bolt bearing raceway groove configured to brake the forward bolt movement on a return portion of a firing cycle corresponding to loading of a new round into the firing chamber.

2. The firearm according to claim 1, wherein the first pair of lateral bearings comprise an oblong shape with a major axis extending in a direction parallel to a first portion of the bolt bearing raceway groove extending from the firing chamber body, and a minor axis orthogonal thereto, a width L of the front lateral bearing in said direction parallel to said first portion of the bolt bearing raceway groove being greater than a height Z of the first pair of lateral bearings.

3. The firearm according to claim 2, wherein the second pair of lateral bearings comprise a cylindrical shape having a diameter D that is greater than the height Z of the first pair of lateral bearings.

4. The firearm according to claim 2, wherein the height (H(y)) of the bolt bearing raceway groove at a position proximate the firing chamber body, corresponds to the height Z of the first pair of lateral bearings, and towards an end of the bolt bearing raceway groove at a position remote from the firing chamber body, the height H(y) corresponds to the height of the second pair of lateral bearings of the bolt diameter D.

5. The firearm according to claim 1, wherein the bolt bearing raceway grooves comprise a first portion parallel to a barrel axis (Y), and a second portion transverse to said barrel axis, the first and second portions connected together to form a "V" shape.

6. The firearm according to claim 5, wherein the velocity control portion is provided in the first portion of the bolt bearing raceway groove, configured to guide and cooperate with the first pair of lateral bearings of the bolt.

* * * * *